US005134857A

United States Patent [19]

Burley

[11] Patent Number: 5,134,857

[45] Date of Patent: Aug. 4, 1992

[54] HOME ICE SKATING RINK

[75] Inventor: William G. Burley, Salix, Pa.

[73] Assignee: Burley's Rink Supply, Inc., Salix, Pa.

[21] Appl. No.: 674,134

[22] Filed: Mar. 25, 1991

[51] Int. Cl.[5] ..... A63C 19/10

[52] U.S. Cl. ..... 62/235; 4/506; 220/404

[58] Field of Search ..... 62/56, 235; 4/506; 220/404

[56] References Cited

U.S. PATENT DOCUMENTS

| | | | |
|---|---|---|---|
| 1,765,074 | 6/1930 | Hooper | 4/506 |
| 2,628,364 | 2/1953 | Wallace et al. | 62/235 X |
| 2,907,362 | 10/1959 | Owen | 62/235 X |
| 2,996,896 | 8/1961 | Johnson | 62/235 |
| 3,797,049 | 3/1974 | De Santo | 62/235 X |
| 3,808,831 | 5/1974 | Landry | 62/235 |
| 3,930,647 | 1/1976 | Berlemont | 62/235 X |
| 3,933,002 | 1/1976 | Vickery | 62/235 X |
| 4,135,634 | 1/1979 | Frye | 62/235 X |
| 4,632,329 | 12/1986 | Burley | 62/235 X |
| 4,815,301 | 3/1989 | Deloughery | 62/235 |

FOREIGN PATENT DOCUMENTS

| | | | |
|---|---|---|---|
| 2403961 | 7/1975 | Fed. Rep. of Germany | 62/235 |
| 387090 | 12/1908 | France | 62/235 |

*Primary Examiner*—Henry A. Bennet
*Assistant Examiner*—Christopher B. Kilner
*Attorney, Agent, or Firm*—Wegner, Cantor, Mueller & Player

[57] ABSTRACT

The portable ice rink consists of plastic sheeting with edges overlapping a perimeter-defining sectional barrier which is on the order of a couple of inches high and clips are provided to hold the sheet in place on the barrier for formation of the ice. In one embodiment, flexible closed cell polyethylene rods are fitted into "off the shelf" straight and angled schedule #40 plastic pipe couplings so as to define a barrier for virtually any desired rink configuration. The durable and light weight polyethylene rods are sufficiently rigid to maintain the desired perimeter during ice formation and are sufficiently compressible and pliable to ease the slip fit of the ends of the rods into the couplings and to more easily accept the sheet retaining clips thereon during set-up of the rink. In the unlikely event that one of the rods should break during handling or the like, it is a simple matter to reconnect the two pieces of the rod together by means of an additional straight pipe coupling. A cover is provided for the ice for deployment over the ice when the rink is not in use, and a particular anchoring system is provided to retain the cover in place.

7 Claims, 2 Drawing Sheets

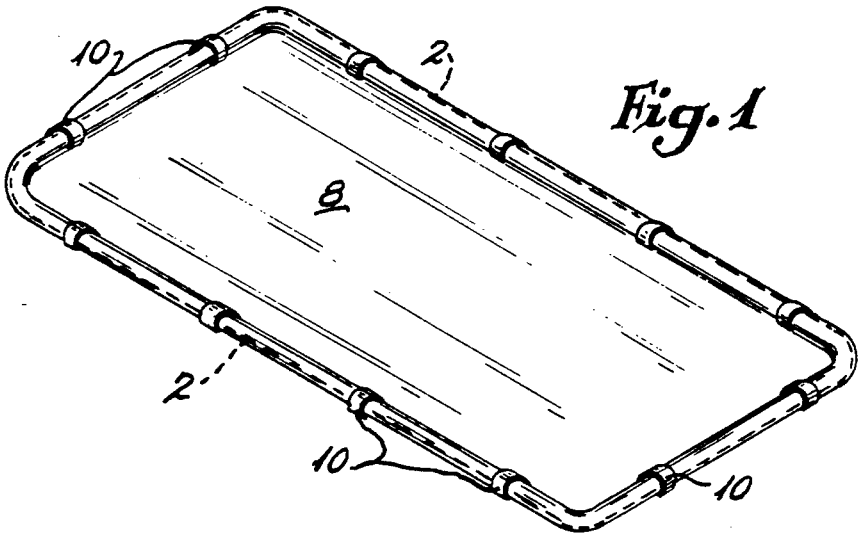
Fig. 1
Fig. 2
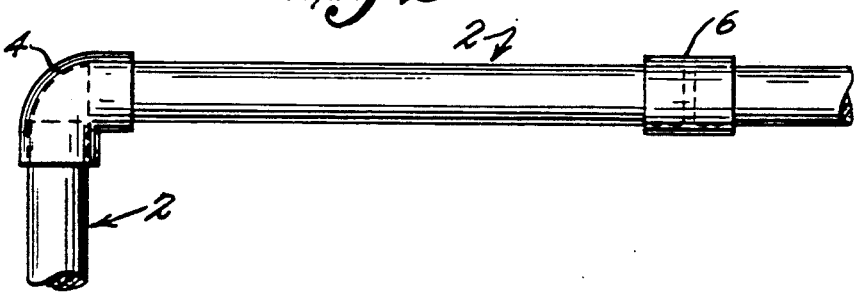
Fig. 3
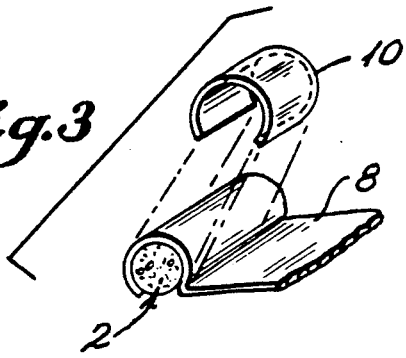
Fig. 9
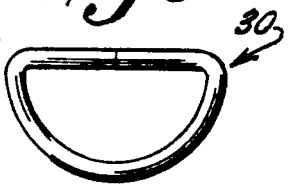
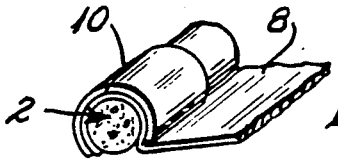
Fig. 4

HOME ICE SKATING RINK

PRIOR ART CROSS REFERENCES

U.S. Pat. No. 2,996,896 — PORTABLE SKATING RINK — Johnson, issued Aug. 22, 1961.

U.S Pat. No. 3,797,049 — MODULAR PORTABLE SKATING RINK — DeSanto, issued Mar. 19, 1974.

U.S. Pat. No. 3,933,002 — SKATING RINK — Vickery, issued Jan. 20, 1976.

BACKGROUND OF THE INVENTION

The field of the invention is ice skating rinks and particularly portable ice skating rinks adapted for use on private lawns, patios, and the like surfaces and requiring only small quantities of water, on the order of a few inches, for the formation of ice.

At one time, so-called "home" ice skating primarily took place on frozen ponds, streams, and other naturally occurring bodies of water. With each of these "home" rinks, there is a real and ever present danger, especially with young children, of death by drowning and/or overexposure upon falling through ice which is too thin to bear the load applied. In order to eliminate this danger, various shallow skating rinks have been proposed for back yard use. While some of the proposals have required powered refrigeration systems for making and maintaining ice, others require only that refrigeration which is provided by Mother Nature.

For instance, it is known to provide a private skating rink which also may double as a wading pool and is made from a vinyl sheet having an integral, inflatable portion which provides a curb for the perimeter of the ice or water. In addition to requiring inflation prior to use, the perimeter curb of this prior art is subject to cutting and/or puncture by skates or the like so as to require patching in order to maintain its inflatability.

Also, U.S. Pat. No. 2,996,896 discloses a portable ice rink constructed of a sectional wooden outer framework to which an additional inner wooden frame is bolted in order to sandwich therebetween and retain the edge of a plastic sheet on which the ice is to be formed. The inner wooden frame is provided primarily as a barrier to prevent cutting of the plastic sheet by the ice skates. The inherent bulkiness of the component parts of such a rink does not lend itself to easy portability and erection of the rink.

U.S. Pat. No. 3,797,049 also discloses a portable ice skating rink or wading pool in which the perimeter is made up of modular semi-rigid side elements, with some of the side elements being elongated and straight and others being curved so as to serve as corners of the perimeter when assembled. One embodiment provides that the tops of the side elements are rounded to mate with correspondingly shaped clamps in order to clamp therebetween the edges of a plastic liner on which the ice is to be formed.

Another so-called portable ice rink is disclosed in U.S. Pat. No. 3,933,002 in which a rigid wall is "formed on site" so as to define the periphery for a separately applied plastic sheet on which the ice is formed. One end of a long plastic tube is tied-off or otherwise closed and the tube is laid out on the ground, with the two ends overlapping so as to close and generally define the perimeter of the rink. Then, the wall is erected by introducing an appropriate material into the open end of the tube and forming the filler material in place. In one embodiment, the filler material is water which is then frozen. In another embodiment, a formed-in-place plastic foam is injected into the tube. Wire clips are provided to hold the separately applied plastic sheet on the tube. There is no disclosure or suggestion of segmenting the formed perimeter wall or of providing couplings for wall segments for purposes of disassembly and ease of reassembly of the rink at another time.

These and other deficiencies in the prior art have been obviated in a novel manner by the present invention, as will be more apparent from the appended claims and upon studying the remaining disclosure.

BRIEF SUMMARY OF THE INVENTION

The portable ice rink consists of plastic sheeting with edges overlapping a perimeter-defining sectional barrier which is on the order of a couple of inches high and clips are provided to hold the sheet in place on the barrier for formation of the ice. In one embodiment, flexable closed cell polyethylene rods are fitted into "off the shelf" straight and angled schedule #40 plastic pipe couplings so as to define a barrier for virtually any desired rink configuration. The durable and light weight polyethylene rods are sufficiently rigid to maintain the desired perimeter during ice formation and are sufficiently compressible and pliable to ease the slip fit of the ends of the rods into the couplings and to more easily accept the sheet retaining clips thereon during set-up of the rink. In the unlikely event that one of the rods should break during handling or the like, it is a simple matter to reconnect the two pieces of the rod together by means of an additional straight pipe coupling. A cover is provided for the ice for deployment over the ice when the rink is not in use, and a particular anchoring system is provided to retain the cover in place.

BRIEF DESCRIPTION OF THE DRAWINGS

FIG. 1 is an isometric view illustrating the assembled ice rink without the cover applied.

FIG. 2 is a top plan view illustrating the connection of several perimeter-defining barrier rods and couplings.

FIGS. 3 and 4 are isometric views illustrating the manner in which the liner clips are applied and utilized to hold the liner in place on the perimeter rods.

FIG. 9 is an elevational view of another form of ring anchor which is adapted to be slipped onto one of the liner clips.

DETAILED DESCRIPTION OF THE INVENTION

Figure 5:
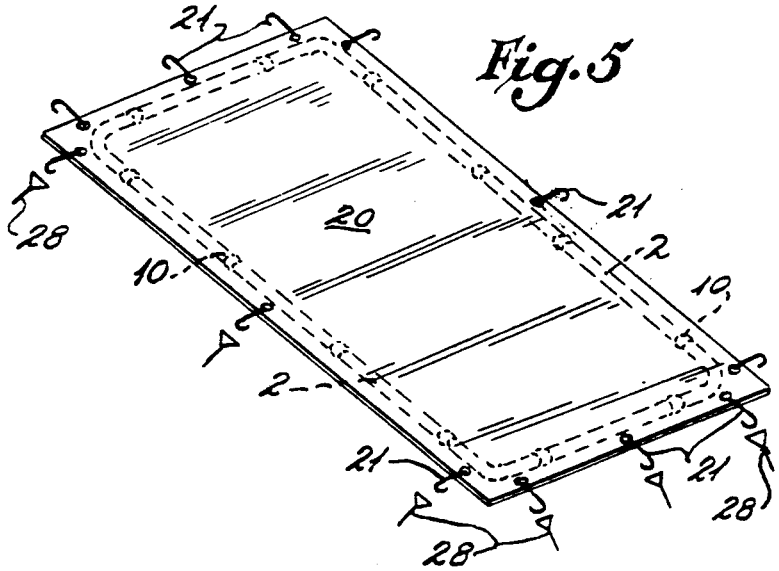
FIG. 5 is an isometric view illustrating a thermal cover positioned over the ice rink and one manner of anchoring the cover in place.

Referring to the drawings, the perimeter of the portable skating rink is defined by a plurality of perimeter rods 2 which are interconnected by means of couplings which may take the form of schedule #40 plastic pipe couplings such as the straight sleeve connector 6 and the elbow connector 4, as seen in FIG. 2. The rink area has been illustrated as generally rectangular in shape, although it is contemplated that other shapes for the skating area may be defined by otherwise orienting the 90° elbow couplings 4 and/or using 45° and 22 ½ couplings or the like which are readily available, off the shelf items.

Once the perimeter has been defined, the plastic sheet liner 8 is spread out over the defined area and the edges of the liner 8 are draped over the barrier and adjusted to lay generally in the manner illustrated in FIG. 3, whereupon liner retaining clips 10 are applied as illustrated in FIGS. 3 and 4. In a prototype, the liner clips 10 comprised a portion of schedule #40 pipe having an internal diameter generally equal to that of the pipe coupling being used and modified by removing an arcuate section over the length of the pipe portion and sufficient for application of the liner clip as illustrated in FIGS. 3 and 4. In use, the clip 10 is somewhat flexible when made from schedule #40 PVC and is substantially less flexible when made from the thicker schedule #80 PVC piping. However, it has been found that the preferred material of the perimeter rods 2 is radially compressible sufficiently to accept schedule #40 and schedule #80 clip liners 10 thereover for attachment of the liner 8 as illustrated in FIGS. 3 and 4. The slight radial compressibility of the rods 2 also eases insertion of them into the couplings 4 and 6.

Having completed attachment of the liner to the perimeter rods, the ice building process is ready to begin, weather permitting.

Ambient temperatures must be below freezing to effectively build the ice sheet, usually requiring close observance of local weather forecasts. Mother Nature's freezing process always commences from the top of the ice and works downward. Thus, rather than filling the liner completely with water, it is wiser to build the ice sheet like the professionals ... a layer at a time. Such a practice eliminates "shell ice" and air entrapment (which is an insulator) beneath the ice surface, and facilitates regulation of the water to be added so that the existing outdoor temperatures can handle the heat load of the newly applied water in a timely manner. Capitalizing on very cold or night weather during the building process will speed formation of the ice sheet. It is recommended that the ice building process be continued until the ice thickness reaches the top of the perimeter barrier.

Figure 6:
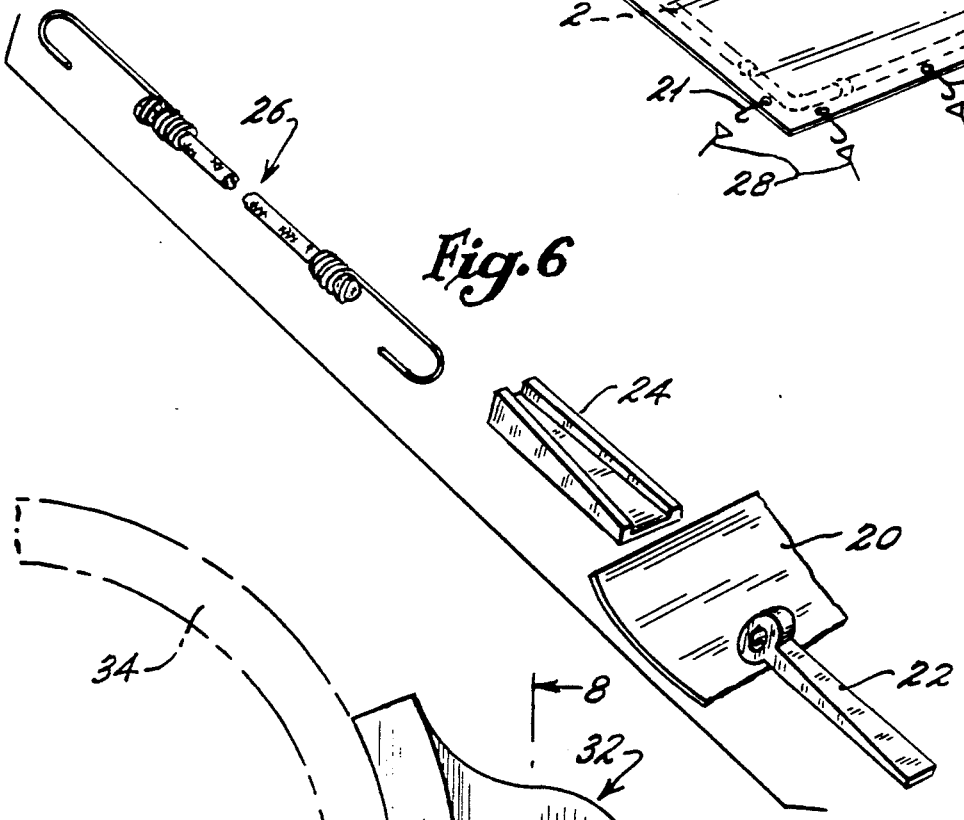
FIG. 6 is an exploded view of a portion of the cover anchoring system.

As seen in FIG. 5, a thermal cover 20 is provided for deployment over the ice during warmer temperatures, intense sunshine, or rain so as to assist in maintaining the ice sheet during and after the ice building process. In order to secure the thermal cover 20 in place over the ice, a removable wedging clamp assembly has been provided for gripping the sheet in various locations, with the wedging assembly being readily removable from the sheet to facilitate rolling or folding the cover when not in use. Typically, the male wedging member 22 is situated on the top side of the cover and the mating, female member 24 is situated on the bottom side of the cover and they are wedged together with the cover therebetween to clamp them to the cover. Various earth anchors 28 (seen in FIG. 5) may be imbedded in the ground and flexible hook members 26 (FIG. 6) may be utilized to connect wedge portion 22 to an anchor 28, under tension.

Figure 7:
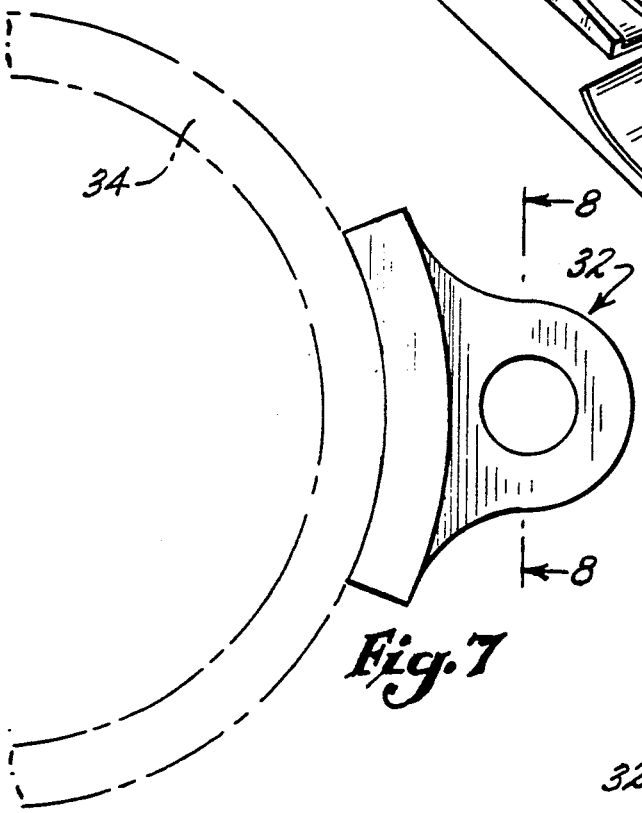
FIG. 7 is an elevational view of fixed ring anchor which is applied to one of the liner clips or barrier couplings.
Figure 8:
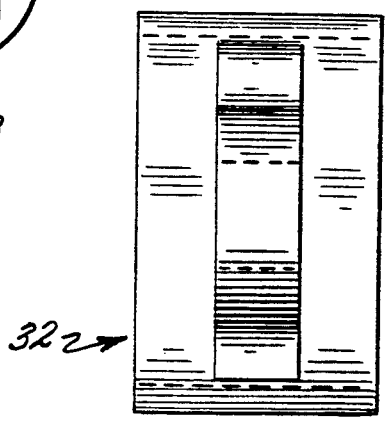
FIG. 8 is a right side elevation of the fixed ring anchor of FIG. 7.

Alternatively, as in FIGS. 7 and 8, a ring member 32 may be provided on a support 34 (such as any of the liner clips 10 or the couplings 4 and 6). Member 32 may be fixed to the support 34 by glue, Velcro, or the like, as well as being integrally formed therewith.

Alternatively, a D-ring 30, as seen in FIG. 9, may be slipped onto one of the liner clips 10 such that the straight portion of ring 30 will be sandwiched between the liner clip 10 and the liner 8 which is draped over rod 2 after installation of liner clip 10. With this embodiment, a simple S-hook can suffice as the tether for attaching wedge member 22 to the ring 30.

It is also contemplated that D-ring 30 or the like may be attached to a generally flat plate member so that the majority of the plate member may be slid under rink and held in place by the weight of the ice, with the ring being situated outside the edge of the rink so that the cover may be tethered thereto in the manner similar to the earlier described embodiments. Alternatively, such a plate could be situated within the boundary so as to be frozen into the ice.

It is also contemplated that the material of cover 20 may be of that disclosed in U.S. Pat. No. 4,632,329, issued Dec. 30, 1986.

A preferred form of the perimeter rods is marketed under the trade name of "Green rod" by NMC of North America, Inc., Zebulon, N.C., as an easily applied filling for static and dynamic masonry joints to control the amount of sealant required for joint design. "Green rod" is an extruded, closed cell polyethylene backer rod which is flexible and compressible with excellent recovery characteristics.

In a prototype of the novel device, the liner and cover consisted of a four layer composite laminate of tri-layer co-extruded polyolifin film which is highly resistant to damage by skate blades and the like and is marketed under the trade name of Permalon by Reef Industries, Inc., Houston, Texas. This material is especially durable, and it is thought that ice "grabs" the ridge-like roughness of it to aid in formation thereof.

The following claims are intended to cover all of the generic and specific features of the invention herein described and all statements of the scope of the invention which as a matter of language, might be said to fall therebetween.

Now that the invention has been described, I CLAIM:

1. A portable ice rink comprising:

sectional barrier means for defining a perimeter of said rink, said barrier means having closed cell foam rods interconnected by socket-like coupling members which are adapted to slidingly receive the ends of said rods;

sheet means for receiving water to be frozen into ice for said rink, edges of said sheet means being draped over said barrier means so as to define a receptacle for said water; and means for retaining said edges draped over said barrier and comprising generally c-shaped clips each having an inner diameter sufficiently large to hold said draped edges closely about an outer surface portion of said rods in preparation for reception and freezing of said water on said sheet.

2. A portable ice rink as in claim 1 and further comprising:

cover means for covering and maintaining said ice when said rink is not being used; and means for anchoring said cover means to said rink such that it can not be blown or otherwise displaced from covering said ice when deployed.

3. A portable ice rink as in claim 2, wherein said anchoring means comprises:

clamps attachable to said cover;

rings attachable to said barrier means; and means for tethering said clamps to said rings.

4. A portable ice rink as in claim 3, wherein:

each said ring is generally D-shaped, providing a straight portion adapted to fit between a corresponding one of said c-shaped clips and said sheet which is retained on said barrier when said ring is slipped onto said clip.

5. A portable ice rink as in claim 3, wherein:

each said ring is attached to a corresponding one of said coupling members.

6. A portable ice rink as in claim 1, wherein:

said rods are sufficiently compressible radially to assist in reception of said ends thereof within said coupling members and in attachment of said clips thereupon.

7. A portable ice rink as in claim 3, wherein said cover clamps comprise:

cooperating male and female wedging members between which said cover is graspable by a wedging action, one of said male and female members having means for attachment of said tethering means thereto.

* * * * *